US005443533A

United States Patent [19]

Magnien

[11] Patent Number: 5,443,533

[45] Date of Patent: Aug. 22, 1995

[54] PAINT TRIMMING APPARATUS

[76] Inventor: Walter Magnien, Box 1146, Camrose, Alberta, Canada, T4V 1X2

[21] Appl. No.: 310,318

[22] Filed: Sep. 22, 1994

[51] Int. Cl.[6] ..... B05C 1/06; B05C 11/00

[52] U.S. Cl. ..... 15/201.1; 15/105; 15/121; 15/166; 15/246; 15/248.1

[58] Field of Search ..... 15/105, 111, 114, 117, 15/118, 121, 166, 210.1, 244.1, 248.1, 246

[56] References Cited

U.S. PATENT DOCUMENTS

| | | | |
|---|---|---|---|
| 558,245 | 4/1896 | Williams . | |
| 562,134 | 6/1896 | Haner . | |
| 587,726 | 8/1897 | Gibbs | 401/48 |
| 1,882,535 | 10/1932 | Weber . | |
| 2,175,587 | 10/1939 | Archer | 15/246 |
| 2,203,106 | 6/1940 | Rogers | 15/119.1 |
| 2,266,962 | 12/1941 | Drucks | 15/210 X |
| 2,584,504 | 2/1952 | Seeber | 15/246 |
| 3,076,216 | 2/1963 | Anderson | 15/116.1 |
| 3,172,140 | 3/1965 | Burns et al. | 15/166 |
| 3,274,617 | 9/1966 | Krantz | 15/248.1 |
| 3,401,418 | 9/1968 | Deck et al. | 15/166 |
| 3,722,019 | 3/1973 | Magnien | 15/114 |
| 4,219,899 | 9/1980 | Zurawin et al. | 15/210.1 |
| 5,134,745 | 8/1992 | Burns et al. | 15/210.1 |

FOREIGN PATENT DOCUMENTS

| | | | |
|---|---|---|---|
| 516760 | 11/1932 | Germany | 15/248.1 |
| 985124 | 3/1965 | United Kingdom | 15/119.1 |
| 1102458 | 2/1968 | United Kingdom | 15/248.1 |
| 1181230 | 1/1970 | United Kingdom | 15/210.1 |

*Primary Examiner*—Edward L. Roberts, Jr.
*Attorney, Agent, or Firm*—Anthony R. Lambert

[57] ABSTRACT

A paint trimming apparatus is described which includes a body and a pad removably secured to the body. The pad has a top, a bottom and an edge angled outwardly from the top toward the bottom. The edge is covered with a liquid impermeable membrane. A guide support is pivotally secured to the body and moveable between a first position covering the impermeable membrane and a second position spaced from the pad. A guide blade is removably secured to the guide support. A handle is secured to the body. The paint trimming apparatus, as described, reduces the frequency of fouling and is easier to clean when fouled by paint.

16 Claims, 3 Drawing Sheets

FIG. 3.
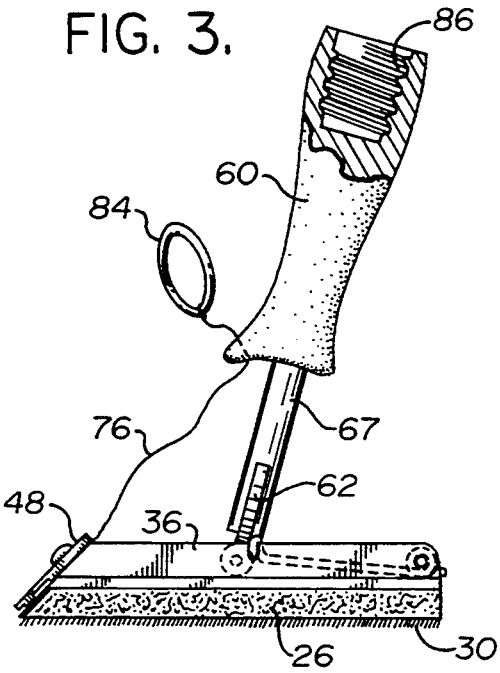
FIG. 4.
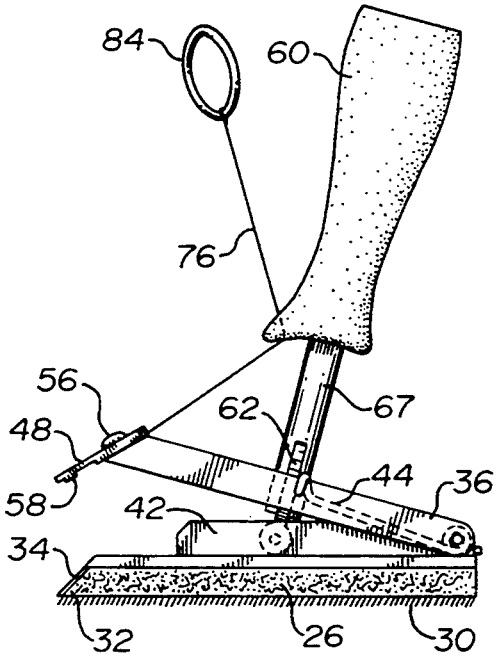
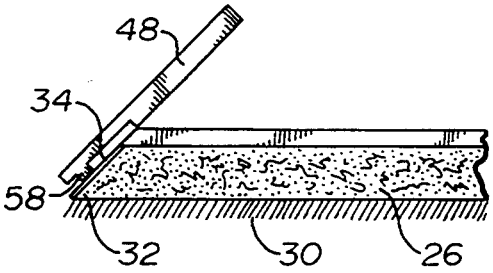
FIG. 5.
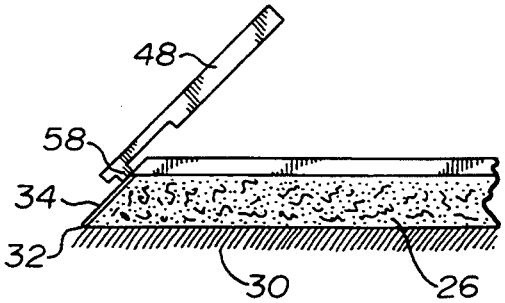
FIG. 6.

PAINT TRIMMING APPARATUS

The present invention relates to a paint trimming apparatus.

BACKGROUND OF THE INVENTION

U.S. Pat. No. 3,722,019 which issued to Walter Magnien in 1973 discloses a paint trimming apparatus which includes a detachable pad carried on a hand held housing. The housing has an angulated guide. A stop is provided against which engages the bristles of the pad holding them clear of the guide to prevent paint from being picked up by the guide during use.

Although useful, the paint trimming apparatus, as described, was subject to fouling. Furthermore, when it became fouled it was difficult to clean. As the guide became worn it became increasingly inaccurate until eventually the paint trimming apparatus lacked utility and had to be disposed of.

SUMMARY OF THE INVENTION

What is required is a paint trimming apparatus that is less subject to fouling and when fouled is easier to clean.

According to the present invention there is provided a paint trimming apparatus which includes a body and a pad removably secured to the body. The pad has a top, a bottom and an edge angled outwardly from the top toward the bottom. The edge is covered with a liquid impermeable membrane. A guide support is pivotally secured to the body and moveable between a first position covering the impermeable membrane and a second position spaced from the pad. A guide blade is removably secured to the guide support. A handle is secured to the body. Means is provided for moving the guide support between the first position and the second position.

The paint trimming apparatus, as described above, avoids fouling in several ways. The guide support pivots away from the pad, so there is little likelihood of the guide blade being fouled when paint is being placed on the pad. The pad has an impermeable membrane along the edge where the guide blade is positioned, so paint cannot migrate through the pad and onto the guide blade. If the guide blade does get fouled, it is removable to permit cleaning.

A number of features for the paint trimming apparatus are preferred. It is preferred that the guide blade have a plurality of adjustment positions. This feature allows the paint trimming apparatus to have greater versatility as it can adapt to differing trim requirements. It is also preferred that the guide blade have a sealing lip that engages the liquid impermeable membrane. This features prevents paint from migrating up the liquid impermeable membrane. It is also preferred that the handle is mounted to the top surface for pivotal movement about both a first axis permitting movement between the front edge and the rear edge and a second axis permitting movement between a first side and a second side. This features allows greater flexibility in manipulating the paint trimming apparatus, especially if such manipulation is being controlled from a distance via an extension handle. It is also preferred that the handle have a threaded female aperture such that a threaded male member from an extension handle is insertable into the threaded female aperture. It is finally preferred that the means for moving the guide support between the first position and the second position include a line having a first end secured to the guide support and a second end extending through an aperture in the handle and terminating in gripping means. This allows the guide support to be pivoted to the second position using one hand and without risk of getting paint on ones hand.

BRIEF DESCRIPTION OF THE DRAWINGS

These and other features of the invention will become more apparent from the following description in which reference is made to the appended drawings, wherein:

FIG. 3 is a side elevation view of the paint trimming apparatus illustrated in FIG. 1, with guide support in a first or lowered position.

FIG. 4 is a side elevation view of the paint trimming apparatus illustrated in FIG. 1, with guide support in a second or raised position.

FIG. 5 is a detailed side elevation view of the pad portion of the paint trimming apparatus illustrated in FIG. 1, with the guide blade in a lowered position.

FIG. 6 is a detailed side elevation view of the pad portion of the paint trimming apparatus illustrated in FIG. 1, with the guide blade in a raised position.

DETAILED DESCRIPTION OF THE PREFERRED EMBODIMENT

Figure 1:
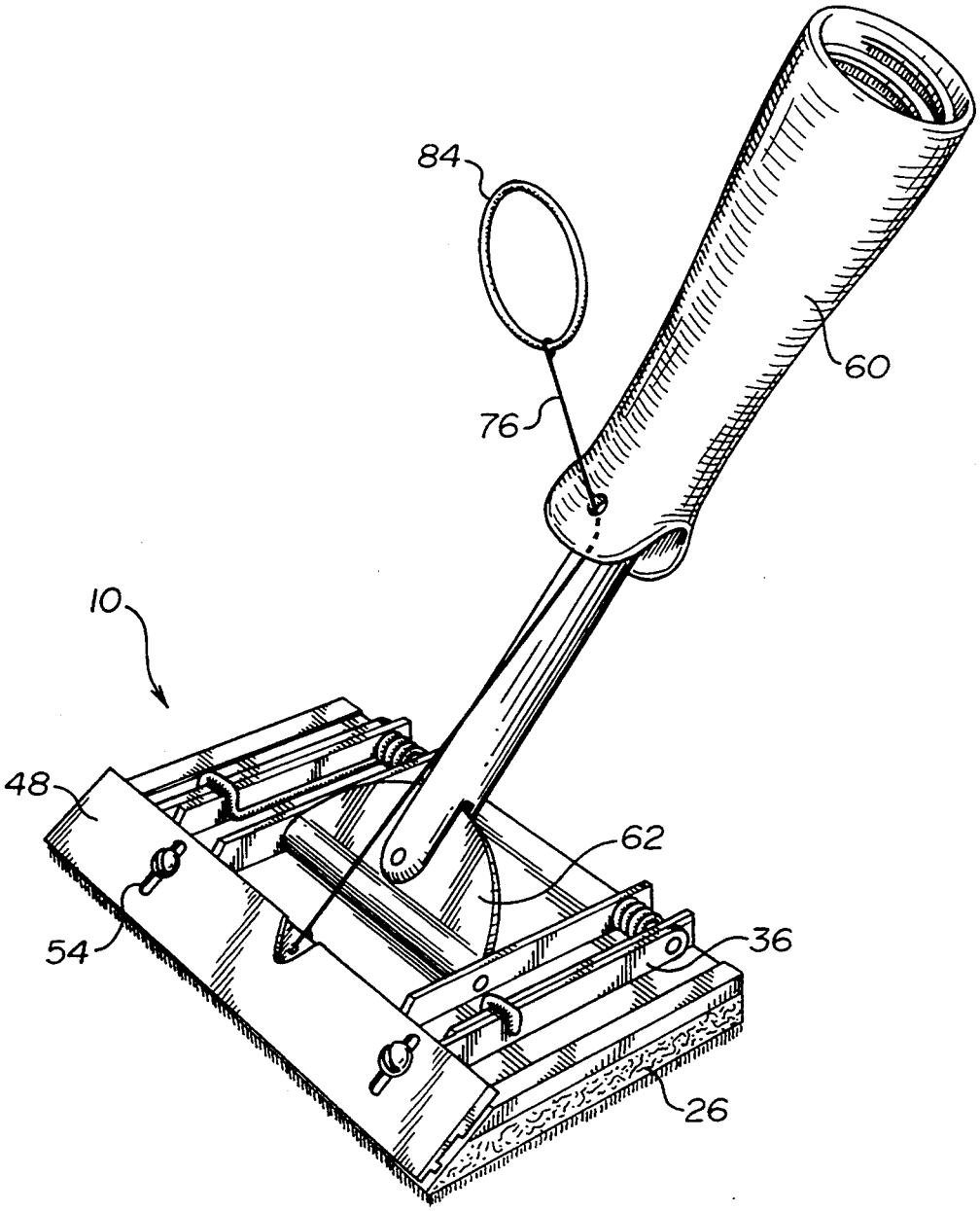
FIG. 1 is a perspective view of a paint trimming apparatus constructed in accordance with the teachings of the present invention.

The preferred embodiment, a paint trimming apparatus generally identified by reference numeral 10, will now be described with reference to FIGS. 1 through 6.

Figure 2:
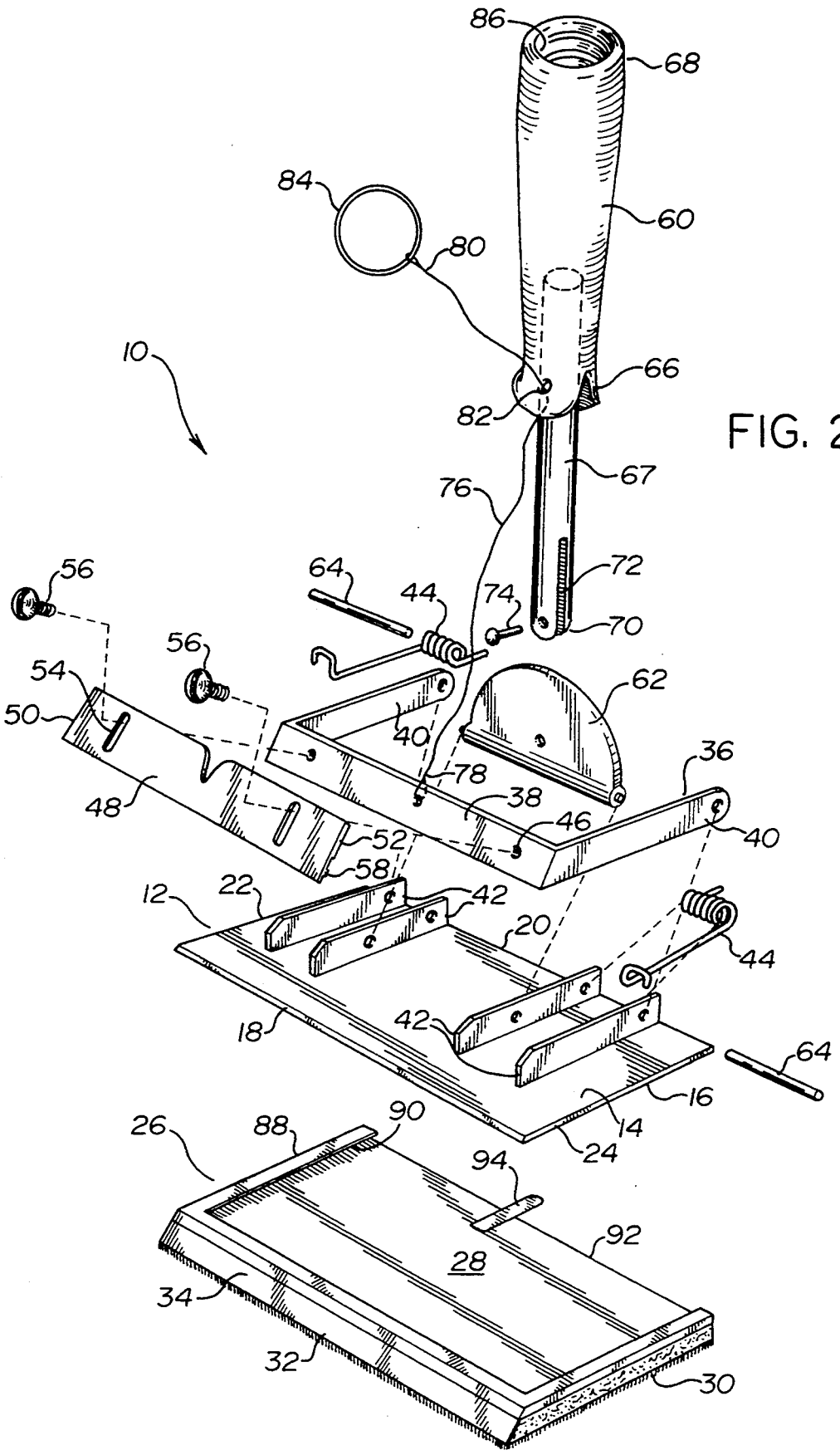
FIG. 2 is an exploded perspective view of the paint trimming apparatus illustrated in FIG. 1.

Paint trimming apparatus is illustrated in a fully assembled form in FIG. 1. Referring to FIG. 2, paint trimming apparatus 10 includes a mounting plate body 12 having a top surface 14, a bottom surface 16, a front edge 18, a rear edge 20, a first side 22 and a second side 24. A pad 26 is removably secured to mounting plate 12. Pad 26 has a top 28, a bottom 30 and a front edge 32 angled outwardly from top 28 toward bottom 30. Front edge 32 is covered with a liquid impermeable membrane 34. A generally "U" shaped guide support 36 is provided having an angular central portion 38 that overlies angled front edge 32 that is covered by impermeable membrane 34. Guide support 36 has opposed ends 40 that are pivotally mounted to brackets 42 on top surface 14 of mounting plate 12. Guide support 36 is pivotally moveable between a first position and a second position. In the first position guide support 36 covers impermeable membrane 34 of pad 26, as illustrated in FIG. 3. In the second position guide support 36 is spaced from pad 26, as illustrated in FIG. 4. Referring to FIG. 2, guide support 36 is biased toward the first position illustrated in FIG. 3 by a spring 44, which engages bracket 42 and guide support 36. Central portion 38 of guide support 36 has two threaded apertures 46, the purpose of which will hereinafter be explained. A guide blade 48 is removably secured to guide support 36. Guide blade 48 has opposed ends 50 and 52 with transverse slots 54 adjacent each of opposed ends 50 and 52. Screws 56 extend through slots 54 and into threaded apertures 46 of central portion 38 to removably secure guide blade 48 to guide support 36. Referring to FIGS. 5 and 6, there are illustrated a range of adjustment positions for guide blade 48. Guide blade 48 has a sealing lip 58 that engages impermeable membrane 34 when guide support 36 is in the first position. Referring to FIG. 2, a handle 60 is pivotally secured to bracket 42 on top surface 14 of mounting plate 12. Handle 60 is mounted for pivotal movement about both a first axis to permit movement between front edge 18 and rear edge 20 and a second axis to permit movement between first side 22 and second side 24. This movement is accommodated by a pivotally mounted semicircular planar member 62. Semi-circular member 62 is pivoted about primary pivot pin 64. Handle 60 has a first end 66 and a second end 68. A shaft 67 extends from first end 66 of handle 60. Shaft 67 has a remote end 70 that has a slot 72. Slot 72 overlies semi-circular member 62 and is secured in position by a secondary pivot pin 74. The first axis which permits movement between front edge 18 and rear edge 20 is primary pivot pin 64. The second axis which permits movement between first side 22 and second side 24 is secondary pivot pin 74. A line 76 is provided having a first end 78 secured to guide support 36 and a second end 80. Line 76 extends through an aperture 82 in first end 66 of handle 60 and terminates at second end 80 in a gripping ring 84. By manipulating gripping ring 84 to exert a force upon line 76, guide support 36 is moved between the first position and the second position, as previously described. Second end 68 of handle 60 has a threaded female aperture 86. Threaded female apertures 86 is intended to received a threaded male member from an extension handle. Pad 26 has a top peripheral edge 88 with a slotted track 90. Slotted track 90 is position on all but rear edge 92 of pad 26. In addition a deformable tab 94 projects outwardly from rear edge 92 of pad 26. Slotted track 90 engages first side 22 and second side 24 and slides onto mounting plate 12 until it also engages front edge 18. Deformable tab 94 is then bent over rear edge 20 of mounting plate 12 to removably secure pad 26 in place.

The use and operation of paint trimming apparatus 10 will now be described with reference to FIGS. 1 through 6. A clean pad 26 is placed onto paint trimming apparatus 10 by having slotted track 90 on pad 26 engage first side 22 and second side 24 and sliding pad 26 onto mounting plate 12 until slotted track 90 also engages front edge 18. Pad 26 is secured in place by bending deformable tab 94 over rear edge 20. Prior to placing any paint onto pad 26, the correct positioning of guide blade 48 is determined. The positioning is adjusted, as required, by loosening screws. Elongate slots 54 permit movement of guide blade 48. When guide blade 48 is in the correct position screws 56 are retightened. Referring to FIG. 4, line 76 is pulled by means of gripping ring 84 to move guide support 36 to the second or raised position to avoid fouling of guide blade 48 while pad 26 is dipped into paint. When gripping ring 84 is gradually released the biasing force of spring 44 causes guide support 36 to return to the first or lowered position as illustrated in FIG. 3. Guide blade 48 is used to avoid fouling areas adjacent pad 26 with paint. Referring to FIGS. 5 and 6, as force is applied to pad 26, paint which migrates through pad 26 is prevented from fouling guide blade 48 by the presence of impermeable membrane 34. Sealing lip 58 prevents paint from migrating up impermeable membrane 34. Handle 60 pivots about primary pivot pin 64 and secondary pivot pin 74 making it easier for pad 26 to paint trim in corners and hard to reach areas. This is particularly important when handle 60 is being manipulated at the end of an extension handle. Pad 26 and guide blade 48 are readily removable for cleaning. Impermeable membrane 34 can be wiped clean.

It will be apparent to one skilled in the art that modifications may be made to the illustrated embodiment without departing from the spirit and scope of the invention as defined by the claims.

The embodiments of the invention in which an exclusive property or privilege is claimed are as follows:

1. A paint trimming apparatus, comprising:

a body;

a pad removably secured to the body, the pad having a top, a bottom and an edge angled outwardly from the top toward the bottom, the edge being covered with a liquid impermeable membrane;

a guide support pivotally secured to the body and moveable between a first position covering the impermeable membrane and a second position spaced from the pad;

a guide blade removably secured to the guide support;

a handle secured to the body; and means for moving the guide support between the first position and the second position.

2. The paint trimming apparatus as defined in claim 1, wherein the body is a mounting plate having a top surface, a bottom surface, a front edge, a rear edge, a first side and a second side.

3. The paint trimming apparatus as defined in claim 2, wherein the handle is mounted to the top surface for pivotal movement about both a first axis permitting movement between the front edge and the rear edge and a second axis permitting movement between a first side and a second side.

4. The paint trimming apparatus as defined in claim 2, wherein the pad has peripheral edge with a slotted track that engages the first side and the second side of the mounting plate body.

5. The paint trimming apparatus as defined in claim 1, wherein the guide support is generally "U" shaped, with an angular central portion that overlies the angled edge that is covered by the impermeable membrane and ends that are pivotally mounted to the body.

6. The paint trimming apparatus as defined in claim 1, wherein the guide blade has a plurality of adjustment positions.

7. The paint trimming apparatus as defined in claim 6, wherein the guide blade has opposed ends with transverse slots adjacent each of the opposed ends, the guide support has at least two threaded apertures, and screws extend through the slots and into the threaded apertures to removably secure the guide blade to the guide support in a selected adjustment position.

8. The paint trimming apparatus as defined in claim 1, wherein the guide blade has sealing lip that engages the impermeable membrane when the guide support is in the first position.

9. The paint trimming apparatus as defined in claim 1, wherein the guide support is biased toward the first position.

10. The paint trimming apparatus as defined in claim 1, wherein the handle is pivotally mounted to the body.

11. The paint trimming apparatus as defined in claim 1, wherein the handle has a threaded female aperture such that a threaded male member from an extension handle is insertable into the threaded female aperture.

12. The paint trimming apparatus as defined in claim 1, wherein the means for moving the guide support between the first position and the second position includes a line having a first end secured to the guide support and a second end extending through an aperture in the handle and terminating in gripping means.

13. A paint trimming apparatus, comprising:

a mounting plate body having a top surface, a bottom surface, a front edge, a rear edge, a first side and a second side; a pad removably secured to the body, the pad having a top, a bottom and an edge angled outwardly from the top toward the bottom, the edge being covered with a liquid impermeable membrane;

a generally "U" shaped guide support having an angular central portion that overlies the angled edge that is covered by the impermeable membrane and ends that are pivotally mounted to the top surface of the mounting plate, the guide support being pivotally moveable between a first position covering the impermeable membrane and a second position spaced from the pad, the guide support being biased toward the first position, the guide support having at least two threaded apertures;

a guide blade removably secured to the guide support, the guide blade having opposed ends with transverse slots adjacent each of the opposed ends, screws extend through the slots and into the threaded apertures to removably secure the guide blade to the guide support in a selected position, the guide blade having a sealing lip that engages the impermeable membrane when the guide support is in the first position;

a handle pivotally secured to the body; and means for moving the guide support between the first position and the second position.

14. The paint trimming apparatus as defined in claim 12, wherein the handle is mounted to the top surface for pivotal movement about both a first axis permitting movement between the front edge and the rear edge and a second axis permitting movement between a first side and a second side.

15. The paint trimming apparatus as defined in claim 12, wherein the means for moving the guide support between the first position and the second position includes a line having a first end secured to the guide support and a second end extending through an aperture in the handle and terminating in gripping means.

16. The paint trimming apparatus as defined in claim 12, wherein the pad has peripheral edge with a slotted track that engages the first side and the second side of the mounting plate body.

* * * * *